US011802670B2

(12) United States Patent
Pretorius et al.

(10) Patent No.: US 11,802,670 B2
(45) Date of Patent: Oct. 31, 2023

(54) LAMP POST WITH TUBULAR POLE

(71) Applicant: Schreder S.A., Brussels (BE)

(72) Inventors: Ettienne Pretorius, Daspoort/Pretoria (ZA); Daniel Kasper, Silverlakes/Pretoria (ZA)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/424,288

(22) PCT Filed: Jan. 23, 2020

(86) PCT No.: PCT/EP2020/051675
§ 371 (c)(1),
(2) Date: Jul. 20, 2021

(87) PCT Pub. No.: WO2020/152294
PCT Pub. Date: Jul. 30, 2020

(65) Prior Publication Data

US 2022/0090749 A1 Mar. 24, 2022

(30) Foreign Application Priority Data

Jan. 23, 2019 (NL) ..... 2022438

(51) Int. Cl.
*F21S 8/08* (2006.01)

(52) U.S. Cl.
CPC ..... *F21S 8/088* (2013.01)

(58) Field of Classification Search
CPC ..... F21S 8/083
See application file for complete search history.

(56) References Cited

U.S. PATENT DOCUMENTS

| | | | | |
|---|---|---|---|---|
| 2010/0231469 | A1 | 9/2010 | Kim | |
| 2017/0214114 | A1 | 7/2017 | Norrell | |
| 2019/0165446 | A1* | 5/2019 | Matchett | H01Q 1/246 |

FOREIGN PATENT DOCUMENTS

| | | | |
|---|---|---|---|
| CN | 2746560 | Y | 12/2005 |
| CN | 201897164 | U | 7/2011 |
| CN | 207146165 | U | 3/2018 |
| EP | 1401048 | A1 | 3/2004 |
| EP | 3076073 | A1 | 10/2016 |
| WO | 2018114510 | A1 | 6/2018 |

OTHER PUBLICATIONS

PCT International Search Report and Written Opinion, Application No. PCT/EP2020/051675, dated Apr. 3, 2020, 11 pages.

* cited by examiner

*Primary Examiner* — Julie A Bannan
(74) *Attorney, Agent, or Firm* — McDonnell Boehnen Hulbert & Berghoff LLP

(57) ABSTRACT

Example embodiments relate to lamp posts with tubular poles. One example lamp post includes a tubular pole made out of a non-metallic material. The lamp post also includes a modular support structure arranged in the pole. The modular support structure includes at least one carrier module for carrying at least one component. The carrier module includes a top interface, a bottom interface, and an elongated structure between the top and bottom interface.

18 Claims, 10 Drawing Sheets

LAMP POST WITH TUBULAR POLE

CROSS-REFERENCE TO RELATED APPLICATIONS

The present application is a national stage entry of PCT/EP2020/051675 filed Jan. 23, 2020, which claims priority to NL 2022438 filed Jan. 23, 2019, the contents of each of which are hereby incorporated by reference.

FIELD OF INVENTION

The field of the invention relates to lamp posts, in particular lamp posts in the form of outdoor luminaires Particular embodiments relate to the field of modular lamp posts with a tubular pole, comprising one or more functional modules aligned with the tubular pole.

BACKGROUND

EP 3 076 073 B1 in the name of the applicant discloses a modular lamp post which is readily assembled and installed in the field whilst providing rigidity, structural integrity and sealing. The lamp post comprises a plurality of modules mounted on a support pole. The modules are connected to one another by respective module connectors and one module thereof is connected to the support pole by a module connector. EP 3 076 073 B1 is included herein by reference.

SUMMARY

The object of embodiments of the invention is to provide an improved lamp post allowing integrating additional functionalities in the lamp post, and in particular allowing integrating an antenna component in a lamp post in an improved manner.

According to a first aspect of the invention there is provided a lamp post. The lamp post comprises a tubular pole and a modular support structure arranged in the tubular pole. The tubular pole is made out of a non-metallic material. The modular support structure comprises at least one carrier module for carrying at least one component, wherein the carrier module comprises a top interface, a bottom interface and an elongated structure between the top and bottom interface.

Embodiments are based inter alia on the inventive insight that by providing a tubular pole made out of a non-metallic material, various components may be arranged in the tubular pole, such as an antenna component, without being hindered by the material of the tubular pole. Further, by providing a modular support structure with one or more carrier modules in the tubular pole, components can be arranged in the pole in a convenient manner by inserting the modular support structure in the tubular pole. Further, the available space in a pole is used in a useful manner, resulting in a compact lamp post.

Preferably, the at least one carrier module comprises a first carrier module and a second carrier module for carrying a first and a second component, respectively. The first carrier module is arranged above or below the second carrier module. The first and second carrier module each comprise a first interface, a second interface and an elongated structure between the first and second interface. The second interface of the first carrier module is connected to the first interface of the second carrier module. The first interface may be a top or a bottom interface, and accordingly the second interface may be a bottom or a top interface.

Preferably, the first carrier module is formed as a first rigid frame and the second carrier module is formed as a second rigid frame which is distinct from the first rigid frame. In that manner a truly modular support structure is obtained, wherein a carrier module can be removed or added without having to disassemble another carrier module. Or, stated differently, the first and the second carrier module do not share a common structural member.

In preferred embodiment, the lamp post is an outdoor luminaire By outdoor luminaires, it is meant luminaires which are installed on roads, tunnels, industrial plants, stadiums, airports, harbors, rail stations, campuses, parks, cycle paths, pedestrian paths or in pedestrian zones, for example, and which can be used notably for the lighting of an outdoor area, such as roads and residential areas in the public domain, private parking areas and access roads to private building infrastructures, etc.

The at least one component may comprise an antenna component. More in particular, the first component and/or the second component may be an antenna component, preferably an antenna component configured for receiving and emitting cellular data. In an exemplary embodiment, the or each antenna component is a substantially cylindrical component comprising a plurality of cylinder segments, each segment being associated with an antenna element. In that manner a large angular range can be covered by the antenna component.

In addition or alternatively, the at least one component may comprise any one of the following: a wireless communication device, a sensor device, such as an RF sensor or a light sensor.

Also further components may be arranged in the tubular pole which are not necessarily supported by the modular support structure, such as a light source, driver circuitry for driving a light source, base station circuitry, power management circuitry, telecommunication circuitry, audio system management circuitry, WiFi circuitry, charger circuitry, an environmental sensor and the associated circuitry, any other type of sensor such as radar sensor, sound sensor, vibration sensor and the associated circuitry, a socket such as an electrical socket, a repeater circuitry, a sign such as a publicity banner, a water discharge device, a trash bin, a human interface device (HID) and the associated circuitry, such as a camera, a loudspeaker, a button, a display, a signaling device, a plug-in device.

Preferably, the non-metallic material is a fiber reinforced plastic material, more preferably a glass fiber reinforced plastic material also called fiberglass. The fibers may be provided in the form of a fabric, e.g. a unidirectional fabric laminate. The tensile strength of the fabric laminate is preferably between 600 and 1000 MPa according to ASTM D3039, and the tensile modulus is preferably between 20 and 60 GPa according to ASTM D3039. The plastic may comprise any suitable polymer, e.g. a thermoset polymer matrix. Instead of glass fibers also other fibers may be used.

Preferably, the tubular pole is cylindrical. However, other shapes such as a prism shape are also possible.

In an exemplary embodiment, a spacer is arranged between the first and the second carrier module. In that manner the first and second component may be arranged at a suitable distance of each other in the tubular pole. Also, the use of a spacer may make it possible to position the second carrier module more easily in different positions with respect to the first carrier module. Preferably, the spacer comprises an upper connection interface, a lower connection interface, and an elongated structure such as a plurality of elongate rods extending between the upper connection interface and the lower connection interface. In other embodiments a tubular section may be used as the elongated structure. The upper and/or the lower connection interface and the corresponding bottom and/or top interface of the carrier module which is connected thereto may be configured such that the second carrier module is positionable in different positions with respect to the first carrier module. To move from a first to a second position of the plurality of positions, the second carrier module may be rotated around an axis which corresponds with the axis of the tubular pole.

According to an exemplary embodiment, the elongated structure of a carrier module comprises a plurality of bars extending between the top interface and the bottom interface. By using bars a light-weight rigid carrier module can be obtained. Optionally, the bars have a substantially U-shaped cross section, preferably with the legs of the U-shape pointing in a substantially radial direction of the tubular pole. The U-shape allows connection lines such as cables to be passed in the channels created by the U-shaped bars. However, in other embodiments the bars may have a different shape. For example, the bars may be tubular members through which one or more cables may extend.

Preferably, the plurality of bars is distributed along a periphery of the carrier module. For example, the plurality of bars may comprise at least three bars equally distributed along the periphery. In that manner, a mechanically robust carrier module is obtained. In that manner the component can be located in an area surrounded by the plurality of bars.

In another exemplary embodiment, instead of or in addition to the plurality of peripheral bars, there may be provided a central rod extending between the top interface and the bottom interface, and the component may be located around the central rod.

According to an exemplary embodiment, the top interface comprises at least one round, preferably ring-shaped, flange and/or the bottom interface comprises at least one round, preferably ring-shaped, flange. In that manner a light-weight rigid carrier module can be obtained. The ring-shaped flanges may be used for connection purposes, but one or more ring-shaped flange may also be used to stabilize at least one component. More in particular, one or more ring-shaped flanges may surround an outer circumference of the component. In that manner, the vibration of the components can be limited.

According to an exemplary embodiment, the lamp post further comprises at least one functional module arranged above or below the tubular pole, and a connection structure for connecting the modular support structure to a functional module of the at least one functional module. The functional modules may be arranged in any order above or below the tubular pole, and may contain one or more function as further described below. It is noted that both the tubular structure and a functional module may comprise an antenna. For example, a functional module at the top of the lamp post may comprise an antenna optionally combined with other functionalities.

Preferably, the connection structure comprises a metal insert arranged at least partially in an end portion of the tubular pole. When the functional module is arranged below the tubular pole, the metal insert may be arranged in a lower end portion thereof, and when the functional module is arranged above the tubular pole, the metal insert may be arranged in an upper end portion thereof. The metal insert may have a shape which is adapted to fit tightly in the pole, e.g. a substantially cylindrical shape. The metal insert may be fixed in the tubular pole, e.g. by gluing or using screw or bolts.

Preferably, the modular support structure is connected to the metal insert. This further enhances the robustness and strength of the lamp post.

Preferably, the connection structure further comprises attachment means configured to allow the modular support structure to be attached in a plurality of positions to the metal insert, such that the support structure is rotatable from one position to another position of said plurality of positions.

For example, the metal insert may be provided with first attachment means such as at least four bolts, and the modular support structure may be provided with second attachment means, such as two hooks configured to be suspended over two of the four bolts. By having multiple bolt pairs, the two hooks can be coupled to different bolt pairs and hence the supports structure can be attached in a plurality of different positions to the metal insert. In that manner, the component can be given a suitable orientation.

It is noted that also the connection interfaces between the first and second carrier module, and/or between the first or second carrier module and the spacer, may be such that the first carrier module can be positioned in different positions with respect to the second carrier module. This is especially advantageous when the first and second components are a first and second antenna components arranged one above the other on the first and second carrier module. In such a configuration, it is generally desirable to orient the second antenna differently compared to the first antenna such that a direction which is not well captured by the first antenna is captured by the second antenna.

Preferably, the connection structure further comprises an internal module connected to the metal insert and arranged at least partially in the metal insert, said internal module having a connection interface. The functional module may then have a corresponding connection interface adapted to be connected to the connection interface of the internal module.

In an exemplary embodiment the connection structure may further comprise two connectors for connecting the corresponding connection interfaces of the internal module and the functional module.

In a preferred embodiment, the functional module comprises an interface formed at an end thereof, said interface being configured for engaging with a complementary interface of the internal module. Further, one or more external or internal module connectors may be provided for connecting the complementary interfaces. Preferably, the module connector has a surface shaped to be complementary to a shaped portion formed by the engaged complementary interfaces. Preferably, the module connector is configured to apply pressure in a first direction when the module connector is tightened against the engaged complementary interfaces. Preferably, the module connector is configured to convert the pressure applied in the first direction to a clamping pressure in a second direction, the second direction being substantially perpendicular to the first direction.

In a preferred embodiment, the lower section of the functional module is provided with a lower round end portion, and is connected to the internal module through one or more pole connectors comprising a first round connector portion and a second round connector portion which together surround the round end portion of the lower section and an adjacent round end portion of the internal module.

In other embodiments, other connection interfaces may be used, such as connection interfaces with polygonal connector portions.

Optionally the lamp post comprises multiple pole modules and, any adjacent pole module of the multiple pole modules may be interconnected through a pole connector comprising a first round connector portion and a second round connector portion which together surround round end portions of the adjacent pole modules.

In other embodiments, splint mechanisms or pivot mechanisms may be used to interconnect two adjacent modules in a rotatable manner. For example, a lower end portion may be provided with a central shaft portion which is configured to be rotatably received in an upper end portion of a lower module, or an upper end portion may be provided with a central shaft portion which is configured to be rotatably received in a lower end portion of an upper module.

The pole connector may have an outer diameter which is substantially the same as an outer diameter of the tubular pole. Also, the tubular pole and the middle section of the functional module may have an outer diameter which is substantially the same. Also the peripheral wall of one or more other pole modules of the lamp post may have substantially the same outer diameter.

According to an exemplary embodiment, the at least one functional module comprises any one or more of the following functionalities: a light source, driver circuitry for driving a light source, base station circuitry, power management circuitry, telecommunication circuitry, audio system management circuitry, WiFi circuitry, charger circuitry, an environmental sensor and the associated circuitry, any other type of sensor such as radar sensor, sound sensor, vibration sensor and the associated circuitry, a socket such as an electrical socket, a repeater circuitry, a sign such as a publicity banner, a water discharge device, a trash bin, a human interface device (HID) and the associated circuitry, such as a camera, a loudspeaker, a button, a display, a signaling device, a plug-in device, an antenna.

According to an exemplary embodiment, the lamp post comprises a light module arranged above the functional module, said light module comprising a light source. In other embodiments, the functional module may be a light module.

According to an exemplary embodiment, the top and/or bottom interface is provided with one or more anti-vibration elements extending from an outer circumference of the top and/or bottom interface in the direction of the tubular pole. In that manner the first and second component can be supported in a robust manner, wherein the vibrational load on the modular support structure is limited. Optionally, the one or more anti-vibration elements comprise a plurality of wings protruding outwardly from the top and/or bottom interface. The anti-vibration elements may be made out of a polymer material.

Preferably, the elongated structure and/or the top and/or bottom interface of a carrier module is made out of metal. However, in other embodiments, the carrier module could also be made out of a rigid plastic material.

Preferably, the elongated structure and/or the top and/or bottom connection interface of a spacer is made out of metal. However, in other embodiments, the spacer could also be made out of a rigid plastic material.

According to an exemplary embodiment the non-metallic material of the tubular pole may comprise a translucent or transparent material. The tubular pole may be fully transparent or translucent, or may have a transparent or translucent portion. Optionally, a light source may be arranged in the tubular pole. The light source may be arranged on a carrier module of the modular support structure but may also be arranged on a different support structure. For example, a PCB with a plurality of light sources arranged thereon may be arranged in the tubular pole, wherein the PCB may be oriented upwardly, e.g. vertically, in the tubular pole.

The tubular pole may be made out of one piece, but could also be made out of a plurality of pieces. For example, the pole could be made of two semi-cylindrical segments coupled together to form a substantially cylindrical pole. Also, the pole may be built with multiple non-metallic tubular sections arranged one above the other, wherein e.g. one of the tubular sections may be transparent or translucent. The tubular sections may be e.g. cylindrical or prism-shaped. Also, the tubular pole could be a "double" tubular pole, e.g. with two merged tubular sections parallel to each other, e.g. two tubular sections having a rectangular cross section. In that case, there may be provided a modular support structure in each tubular section.

According to an exemplary embodiment, the lamp post further comprises one or more connection lines for connecting the first and/or second component, wherein preferably the connection lines are arranged along the elongated structure. The one or more connection lines may extend from a component arranged in the tubular pole to a functional module above and/or below the tubular pole. More in particular, the one or more connection lines may extend from the component, through channels formed by the elongated structure of the carrier module, and through the connection structure into the functional module. The connection lines may further extend to other modules of the lamp post.

According to an exemplary embodiment, the tubular pole is provided with at least one removable door providing access to an inner part of said tubular pole. The at least one removable door may comprise a first door providing access to a level between the first and the second carrier module and/or a second door providing access to the second interface of the second carrier module. In case of only one carrier module, the removable door is preferably located just below or just above the carrier module, depending on whether the support structure is arranged in an upper or lower end of the tubular pole.

According to an exemplary embodiment, the tubular pole comprises a pole base part buried in the ground G, said pole base part optionally being provided with a base plate and/or with a cable entry opening.

According to an exemplary embodiment, the light source comprises a plurality of light emitting diodes, e.g. an array of light emitting diodes, which may be arranged on a PCB. Further, a driver for driving the plurality of light emitting diodes, optionally in combination with a dimmer may be integrated in the lamp post in any known manner. Further, the lamp post may be provided with a control means. The control means may be configured to control the driver based on data received through the one or more antenna components or based on other data. It is noted that an antenna may also be located on top of the lamp post or in a functional module.

According to an exemplary embodiment, the tubular pole may be provided with one or more ventilation openings, e.g. a plurality of slits or holes, such that an air flow through the tubular pole is created. Preferably the one or more ventilation holes are provided in an upper half of the tubular pole. In a possible embodiment, one or more ventilation holes may be provided in one or more access doors of the tubular pole. By providing one or more ventilation holes cooling of the at least one component and/or a component of the functional module can be achieved.

According to an exemplary embodiment, a fan is arranged in the tubular pole. The fan is preferably arranged to increase the air flow through the tubular pole.

BRIEF DESCRIPTION OF THE FIGURES

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which:

FIG. 2I is a top view looking at CC of FIG. 2H.

DESCRIPTION OF EMBODIMENTS

Figure 1A:
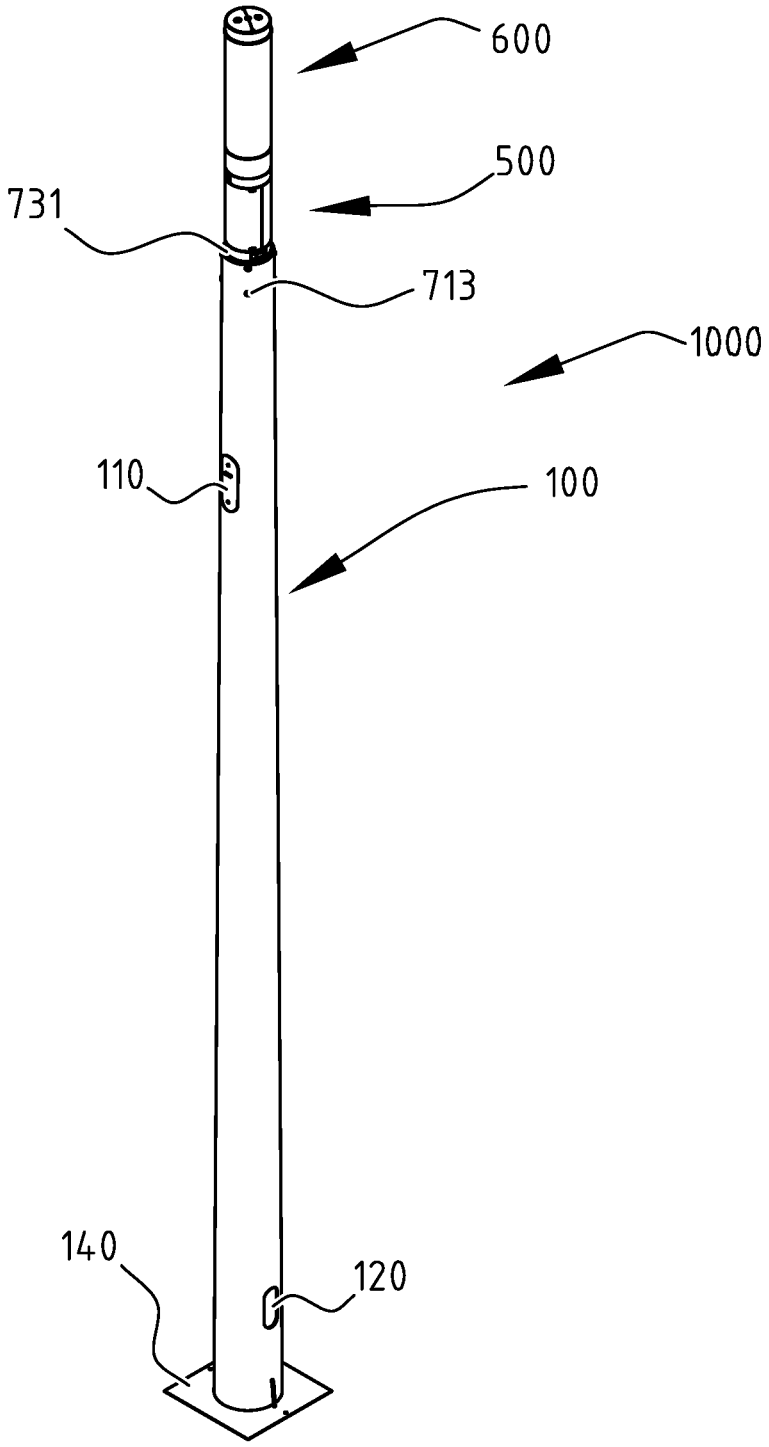
FIG. 1A is a schematic perspective view of an exemplary embodiment of a lamp post of the invention.
Figure 1B:
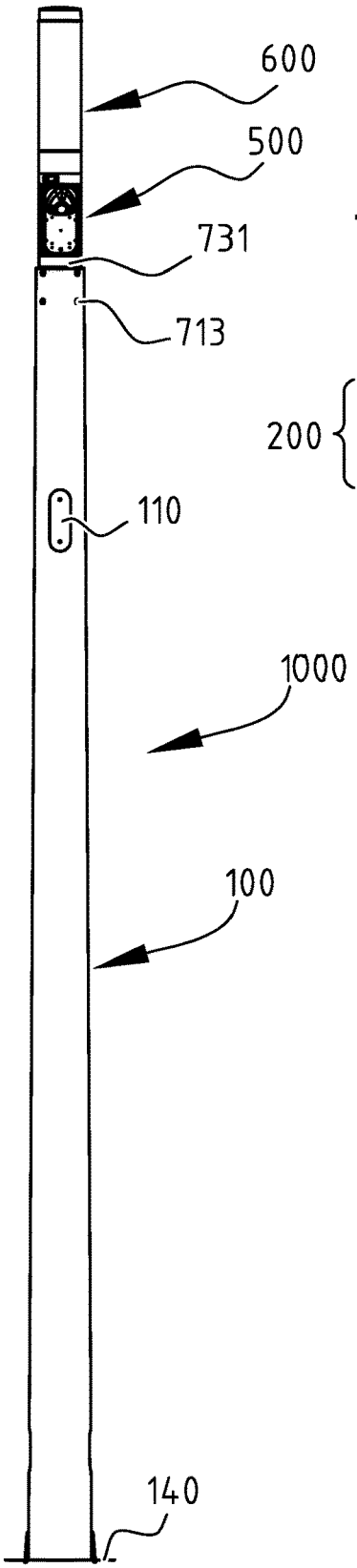
FIG. 1B is a front view of the lamp post of FIG. 1A.
Figure 1C:
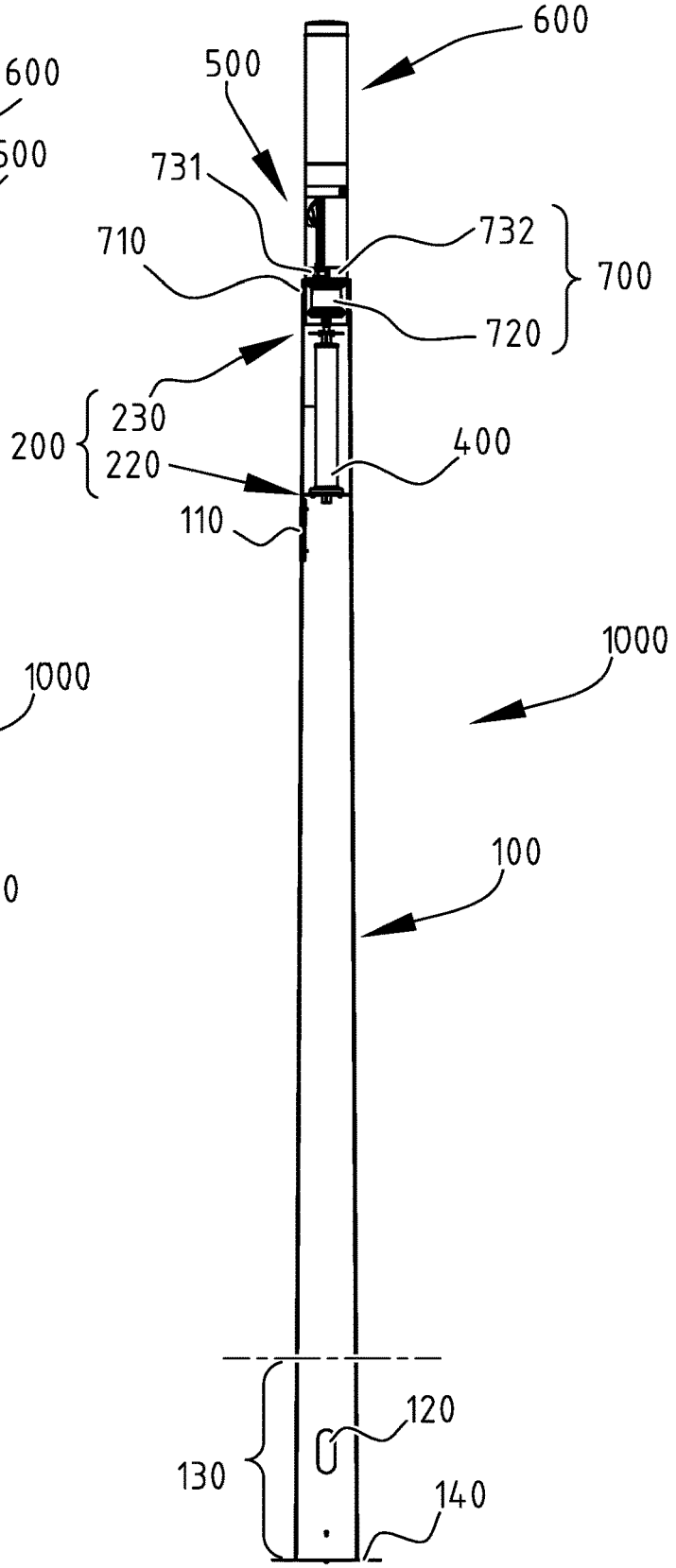
FIG. 1C is a side view of the lamp post of FIG. 1A with a portion of the tubular pole removed to reveal an inner part of the lamp post.

FIGS. 1A, 1B and 1C illustrate schematically an exemplary embodiment of a lamp post 1000. The lamp post 1000 comprises a tubular pole 100, a modular support structure arranged in said pole 100, an optional functional module 500 and a light module 600. The tubular pole 100 is made out of a non-metallic material, e.g. a fiber reinforced plastic material. The modular support structure comprises at least one carrier module 200 for carrying a component 400. In FIG. 1C only one carrier module 200 is shown, but optionally a further carrier module with a further component can be arranged below the carrier module 200. Such an embodiment will be discussed below with reference to FIGS. 2A-2H. The component 400 may be an antenna component, preferably an antenna component configured for receiving and emitting cellular data. The antenna component 400 may be a substantially cylindrical component comprising a plurality of cylinder segments, wherein each segment is associated with an antenna element.

There may be arranged one component 400 per carrier module 200 as in the embodiment of FIGS. 1A-1C, but it is also possible to arrange multiple components 400 on the same carrier module 200. A component may be any one of the following: an antenna element, a wireless communication device, a sensor device. Although not shown, one or more further components may be provided in the tubular pole which may or may not be supported by a carrier module. For example, the tubular pole may be transparent or translucent, or have a transparent or translucent portion, and a light source may be arranged therein.

As shown in FIG. 1C, the carrier module comprises a bottom interface 220, a top interface 230 and an elongated structure (not visible) between the top and bottom interface. A possible implementation of the elongated structure will be discussed below with reference to FIG. 3A.

A connection structure 700 connects the modular support structure 200 to the functional module 500. The connection structure 700 comprises a metal insert 710 arranged in an end portion of the tubular pole 100. The metal insert 710 may be fixed to the pole 100 using screws or bolts 713. In another embodiment the metal insert may be glued in the pole 100. The metal insert 710 may be substantially cylindrical such that it fits well in the hollow pole 100. The carrier module 200 is connected to the metal insert 710 using attachment means. Possible attachment means will be discussed below with reference to FIGS. 2A-2H. The attachment means may be configured to allow the carrier module 200 to be attached in a plurality of positions to the metal insert 710, such that the carrier module is rotatable from one position to another position of said plurality of positions. The connection structure 700 further comprises an internal module 720 connected to the metal insert 710 and arranged at least partially in the metal insert. The internal module 720 has an upper connection interface, and the functional module 500 has a corresponding lower connection interface. The connection structure 700 further comprises two connectors 731, 732 for connecting the corresponding connection interfaces of the internal module 720 and the functional module 500.

The tubular pole 100 is provided with at least one removable door 110 providing access to an inner part of the tubular pole 100. In the illustrated embodiment, only one door is shown, and this door will provide access to the bottom interface 220 of the shown carrier module 200, and to the top interface of an optional further carrier module (not shown) which may be present below. Optionally a second door (not shown) may provide access to a bottom interface of the further carrier module (if present).

As illustrated in FIGS. 1B and 1C, the tubular pole 100 may comprise a pole base part 130 buried in the ground G, said pole base part 130 optionally being provided with a base plate 140 and/or with a cable entry opening 120.

A second exemplary embodiment of a lamp post with a tubular pole 100 will now be described with reference to FIGS. 2A-2I. FIG. 2F illustrates a lamp post 1000. The lamp post 1000 comprises a tubular pole 100, a modular support structure 200, 200' arranged in said pole 100, an optional functional module 500 and a light module 600. The tubular pole 100 is made out of a non-metallic material, e.g. a fiber reinforced plastic material. The modular support structure comprises multiple carrier modules 200, 200' for carrying multiple components 400, 400'. The modular support structure comprises a first carrier module 200 and a second carrier module 200' for carrying a first and a second component 400, 400', respectively. The first carrier module 200 is arranged above the second carrier module 200'. Optionally, the tubular pole 100 is provided with at least one removable door 110 providing access to an inner part of said tubular pole 100 and to the modular support structure 200, 200'. A first door 110 may be provided at a level between the first and the second carrier module 200, 200'. Optionally a second door (not shown) may be provided to provide access to the second bottom interface 230 of the second carrier module 200'.

Figures 2A, 2C, 2D, 2E:
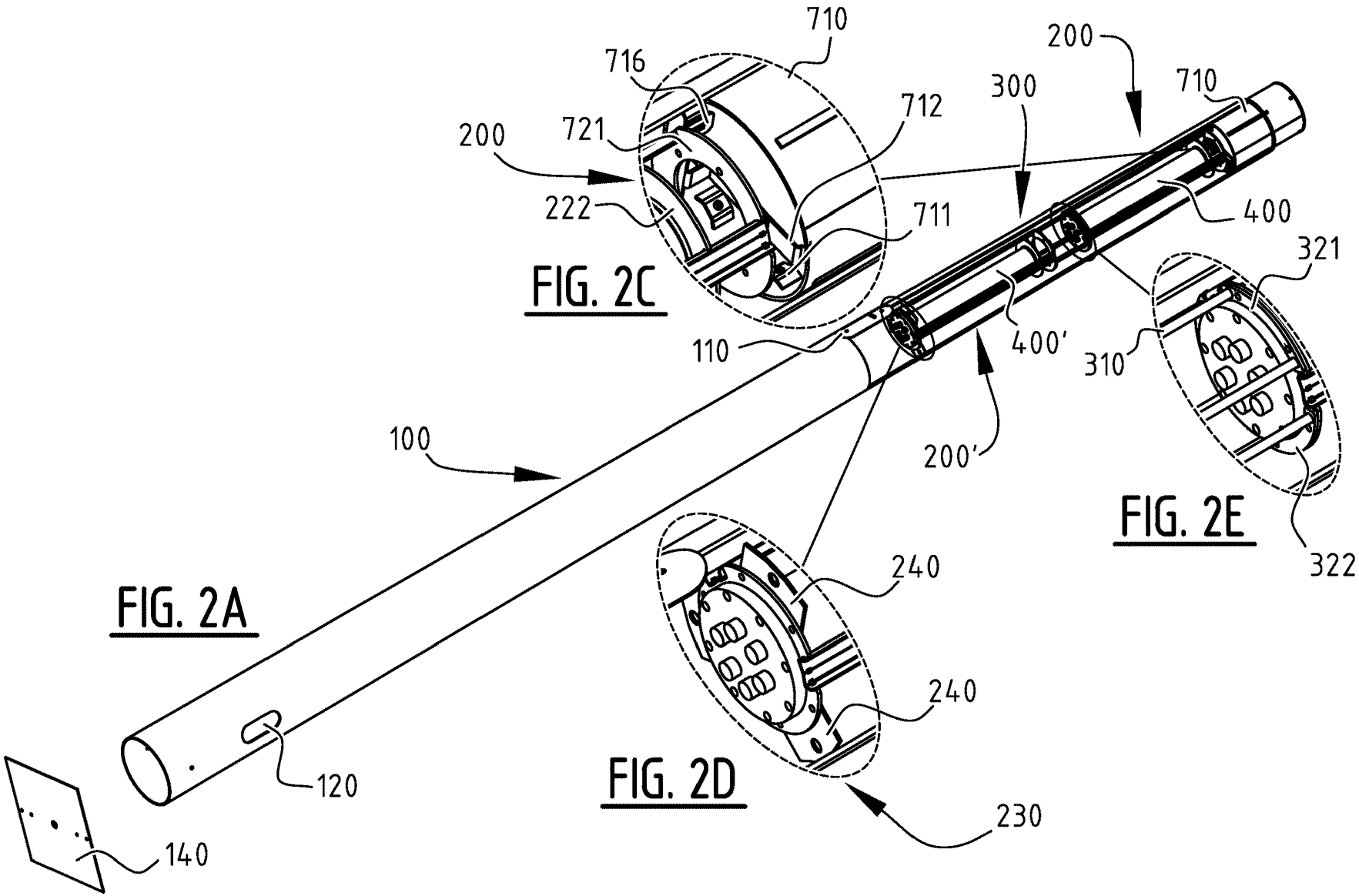
FIG. 2A is a schematic perspective view of an exemplary embodiment of a tubular pole and modular support structure of a lamp post.
FIGS. 2C, 2D and 2E are detailed views of portions of FIG. 2A.
Figure 2B:
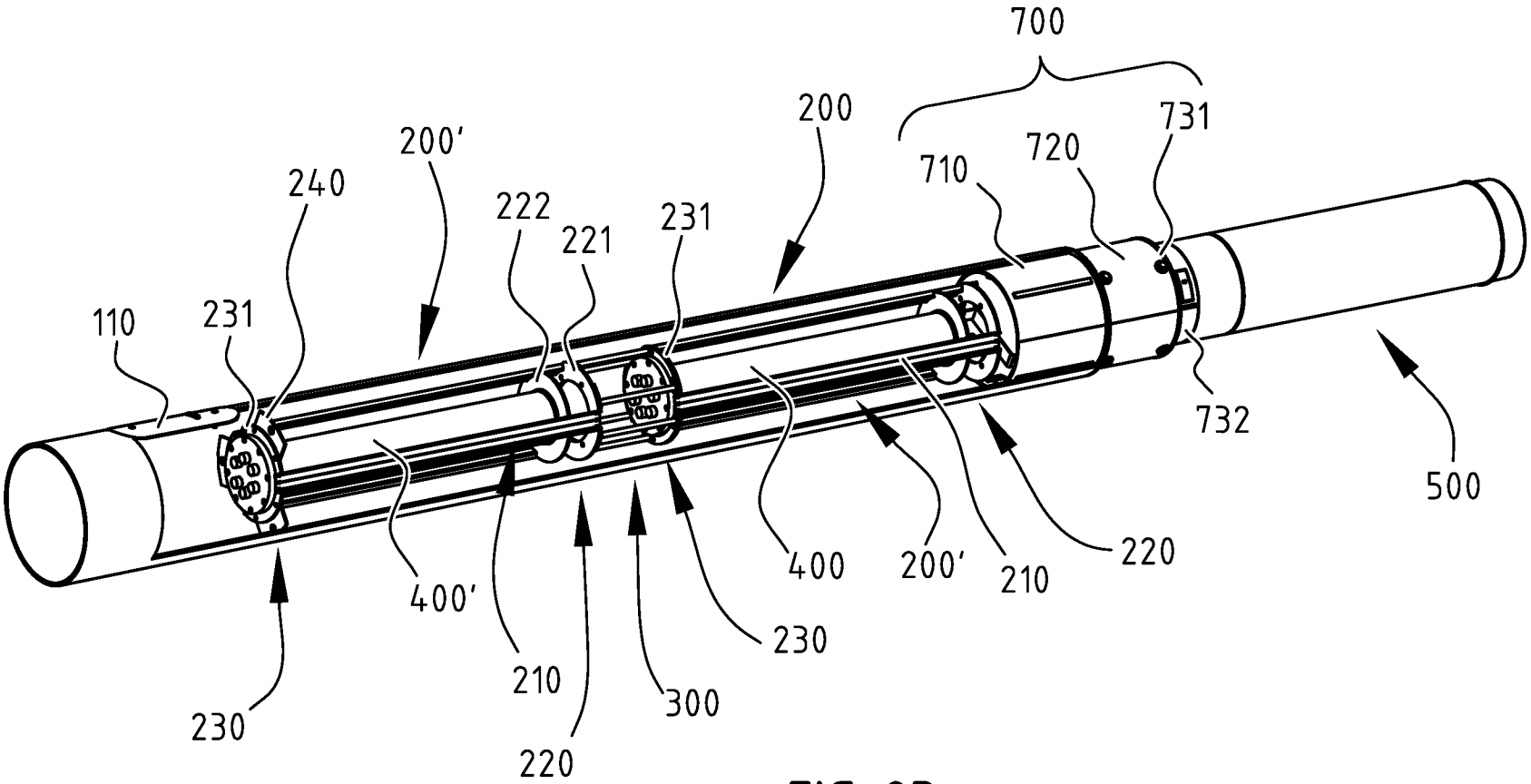
FIG. 2B is a schematic perspective view of the embodiment of FIG. 2A connected to a functional module.
Figure 2F:
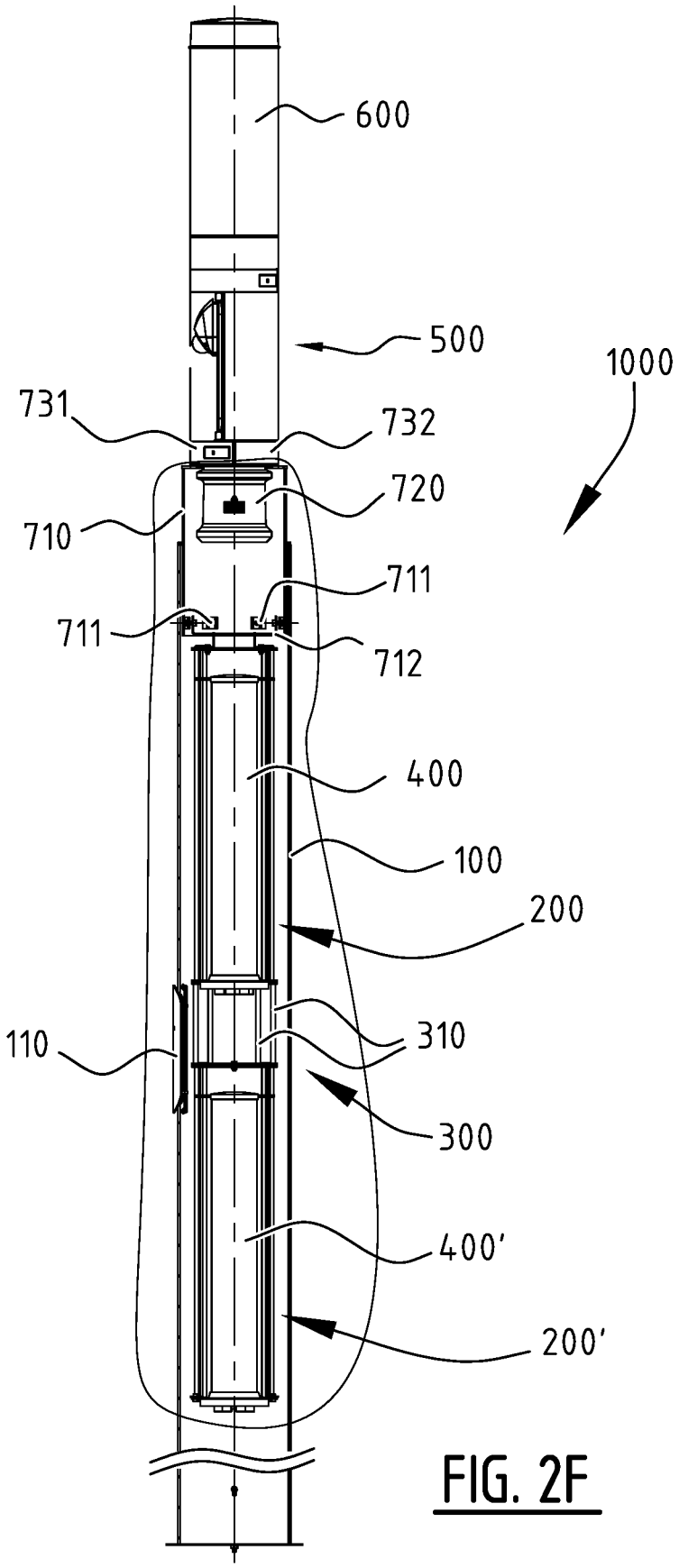
FIG. 2F is a front view of a lamp post including the tubular pole of FIG. 2A, wherein the pole has been partially opened to render the carrier modules and the connection structure visible.

As shown in FIG. 2B, the first and the second carrier module 200, 200' each comprise a top interface 220, a bottom interface 230 and an elongated structure 210 between the top and bottom interface 220, 230, wherein the bottom interface 230 of the first carrier module 200 is connected to the top interface 220 of the second carrier module 200'. When the first and/or second component 400, 400' need to be connected in a wired manner to other components associated with the lamp post, e.g. to a controller, connection lines for connecting the first and/or second component 400, 400' may be arranged/guided along the elongated structure 210.

Figure 3A:
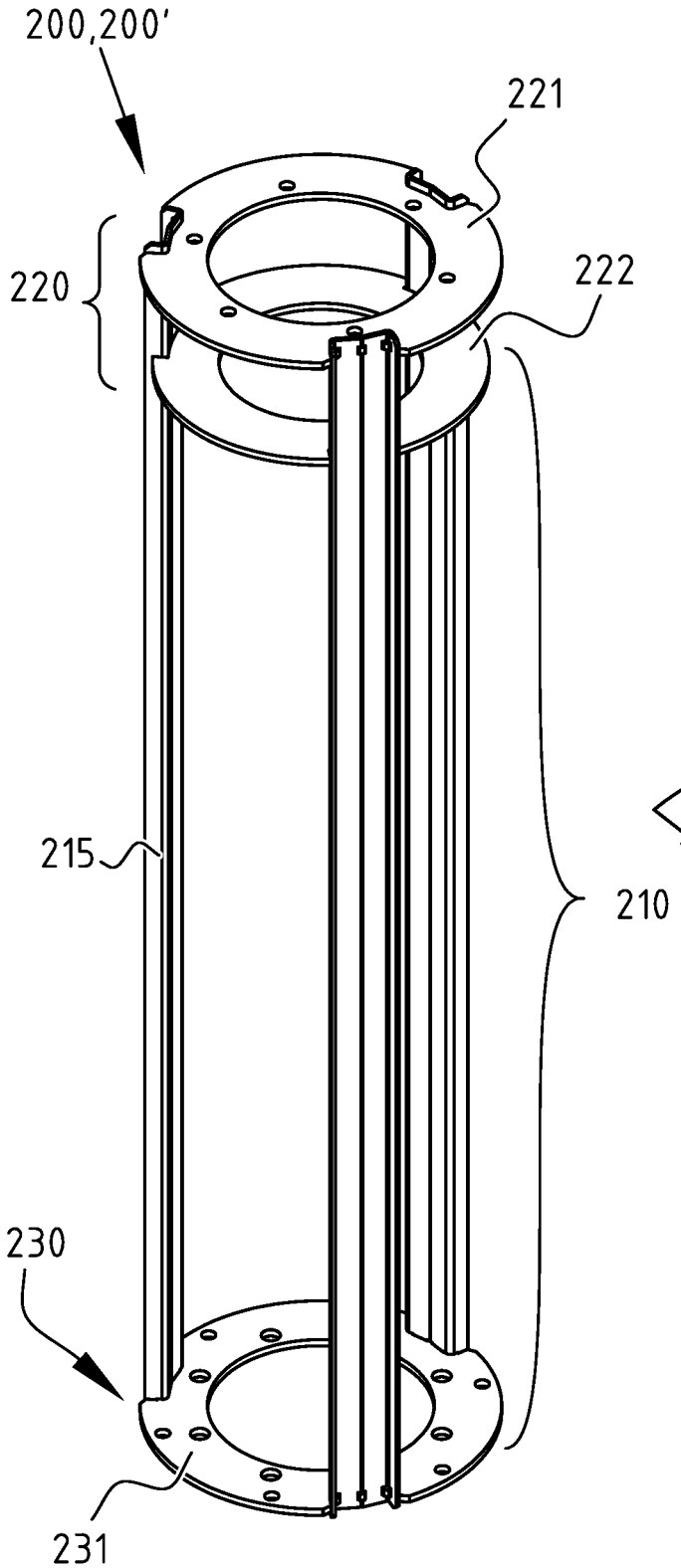
FIG. 3A is a schematic perspective view of an exemplary embodiment of a carrier module for use in a lamp post.
Figure 3B:
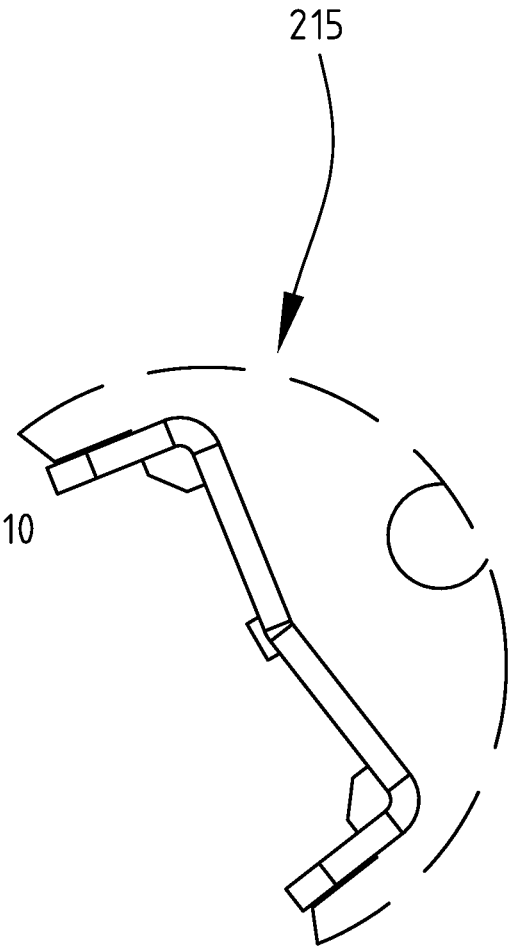
FIG. 3B illustrates a cross section of a member of the elongated structure of the carrier module of FIG. 3A.

FIG. 3A illustrates in detail a possible embodiment of a carrier module 200, 200' comprising a top interface 220, a bottom interface 230 and an elongated structure 210. The elongated structure 210 comprises a plurality of bars 215 extending between the top interface and the bottom interface. In that manner an open rigid frame is provided which is suitable for carrying an antenna component without significantly hindering the good operation of the antenna component. As illustrated in FIG. 3B, the bars 215 may have a substantially U shaped cross section with the legs of the U-shape pointing in a substantially radial direction of the tubular pole. In that way the bars form channels in which one or more cables may be guided. The one or more cables may run from a component 400 or 400' in the bars 215, through the connection structure 700, into the functional module 500. The top interface 220 may comprise at least one round, preferably ring-shaped, flange 221, 222. In the illustrated embodiment the ring-shaped flange may surround an outer circumference of the component 400, 400' in order to stabilize the component 400, 400' and reduce any vibration thereof. The bottom interface 230 may comprise at least one round, preferably ring-shaped, flange 231. Optionally, the top and/or bottom interface 220, 230 may be provided with one or more anti-vibration elements 240 (see FIG. 2D) extending from an outer circumference of the top and/or bottom interface 220, 230 in the direction of the tubular pole 100. The one or more anti-vibration elements 240 may comprise a plurality of wings protruding outwardly from the top and/or bottom interface 220, 230.

Figure 4:
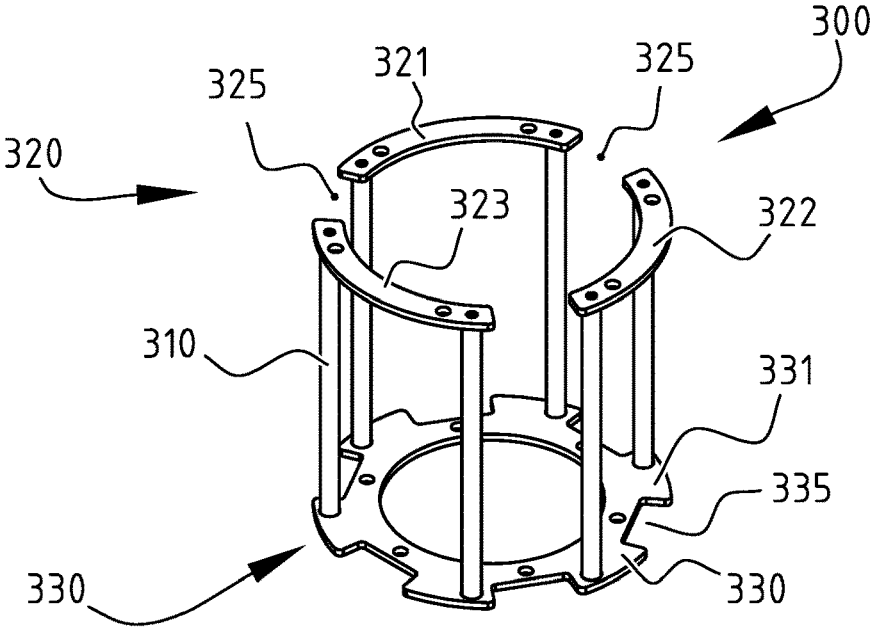
FIG. 4 is a schematic perspective view of an exemplary embodiment of a spacer for use in a modular support structure.

As shown in FIGS. 2A, 2B, 2F and 2G, a spacer 300 may be arranged between the first and the second carrier module 200, 200'. An embodiment of a spacer 300 is shown in FIG. 4. The spacer 300 comprises an upper connection interface 320 for connection to the second carrier module 200, a lower connection interface 330 for connection to the first carrier module 200', and a plurality of elongate rods 310 extending between the upper connection interface 320 and the lower connection interface 330. In that manner a rigid spacer 300 is obtained allowing providing a suitable distance between the first and second components 400 and 400'. The upper connection interface 320 comprises a plurality of ring segments 321, 322, 323 for cooperating with a lower flange 231 of the first carrier module 200. The lower connection interface 330 comprises a ring-shaped flange 331 for cooperating with an upper flange 221 of the second carrier module 200'.

Figure 2G:
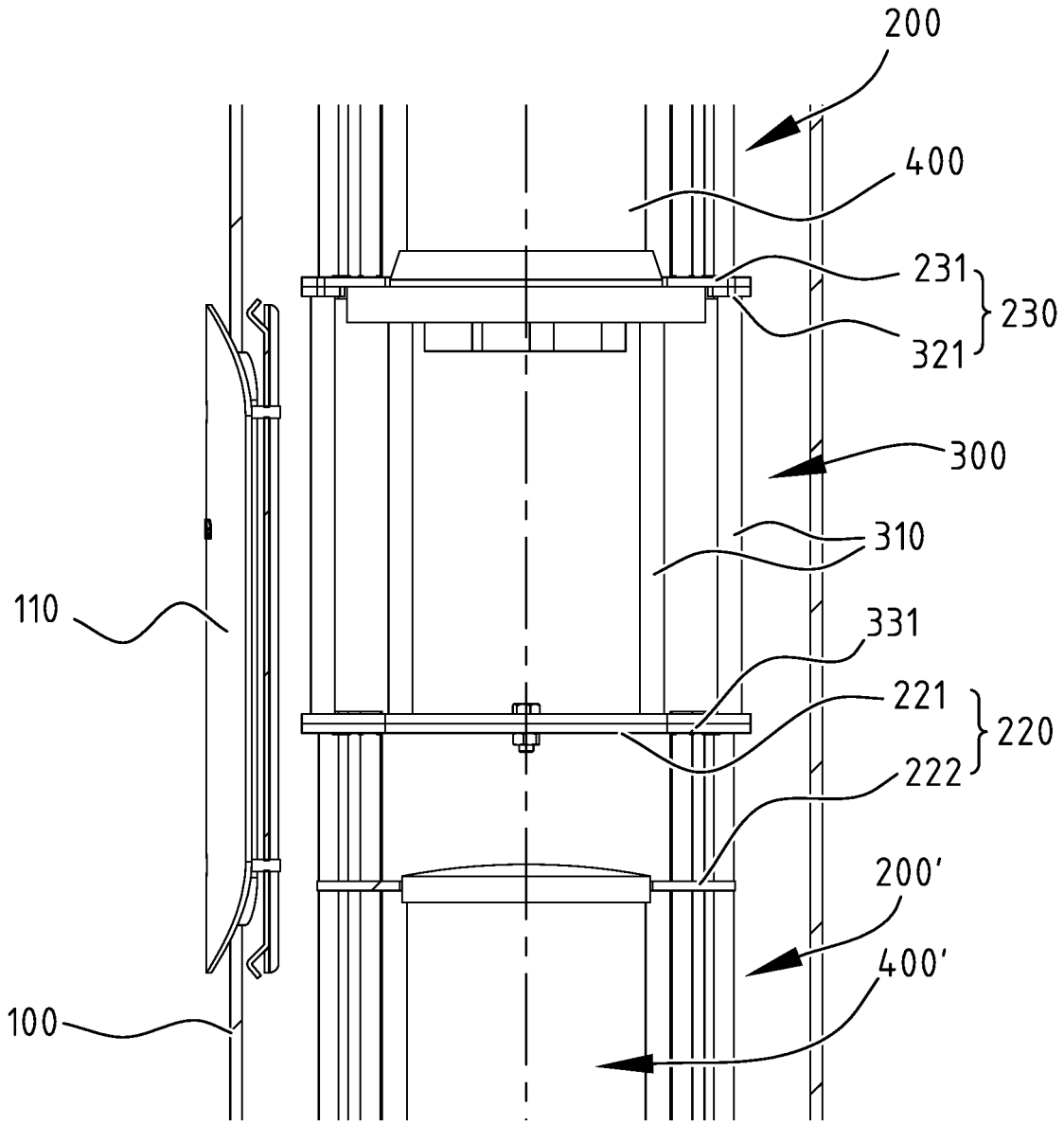
FIG. 2G is a detailed view of the spacer shown in FIG. 2F in the connected state.

The use of the spacer 300 makes it possible to position the second carrier module more easily in different positions with respect to the first carrier module. The upper and/or the lower connection interface 320, 330 and the corresponding bottom and/or top interface 230, 220 of the carrier module 200, 200' which is connected thereto may be configured such that the second carrier module 200' is positionable in different positions with respect to the first carrier module 200. To move from a first to a second position of the plurality of positions, the second carrier module 200' may be rotated around an axis which corresponds with the axis of the tubular pole. More in particular, as shown in FIGS. 2B and 2G, the bottom interface 230 of the first carrier module 200 may be adapted to be aligned with the upper connection interface 320 of the spacer 300 and the top interface 220 of the second carrier module 200' may be adapted to be aligned with the lower connection interface 330 of spacer 300. For example, the lower connection interface 330 may be provided with protrusions or recesses cooperating with recesses or protrusions of the top interface 220. In the illustrated embodiment the ring-shaped flange 331 of the lower connection interface 330 is provided with recesses 335 for cooperating with upper end portions of the bars 215 which form protrusions at the top interface 220. In a similar manner, the upper connection interface 320 may be provided with protrusions or recesses cooperating with recesses or protrusions of the bottom interface 230. In the illustrated embodiment the ring-shaped segments 321, 322, 323 of the upper connection interface 330 form recesses 325 for cooperating with lower end portions of the bars 215 which form protrusions at the bottom interface 230.

The fact that the second carrier module 200' can be positioned in different rotation positions is especially advantageous when the first and second components 400, 400' are first and second antennas arranged one above the other on the first and second carrier module 200, 200'. In such a configuration, it is generally desirable to orient the second antenna 400' differently compared to the first antenna 400 such that a direction which is not well captured by the first antenna 400 is captured by the second antenna 400'.

Figure 2H:
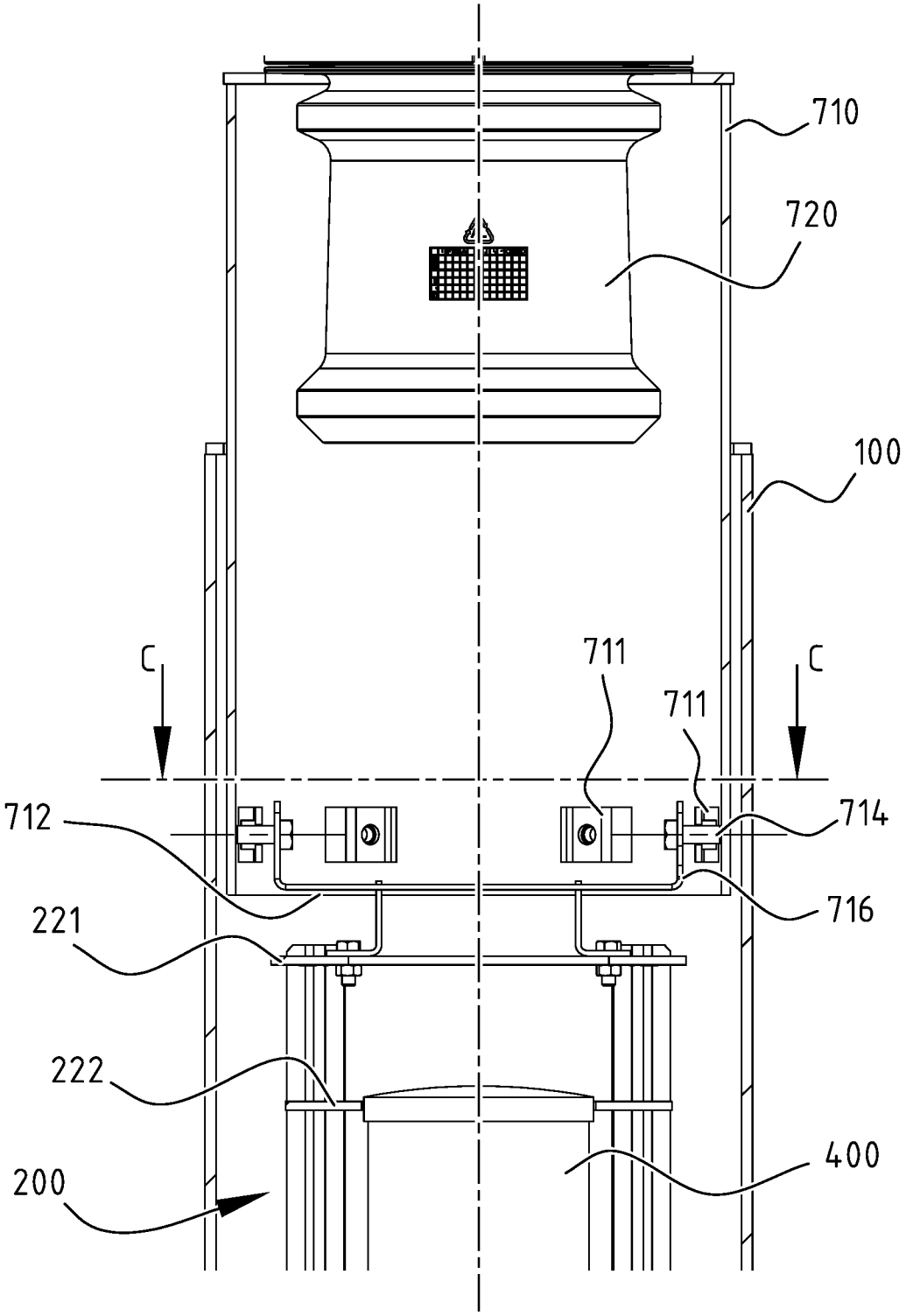
FIG. 2H is a detailed view of the connection structure shown in FIG. 2F.
Figure 21:
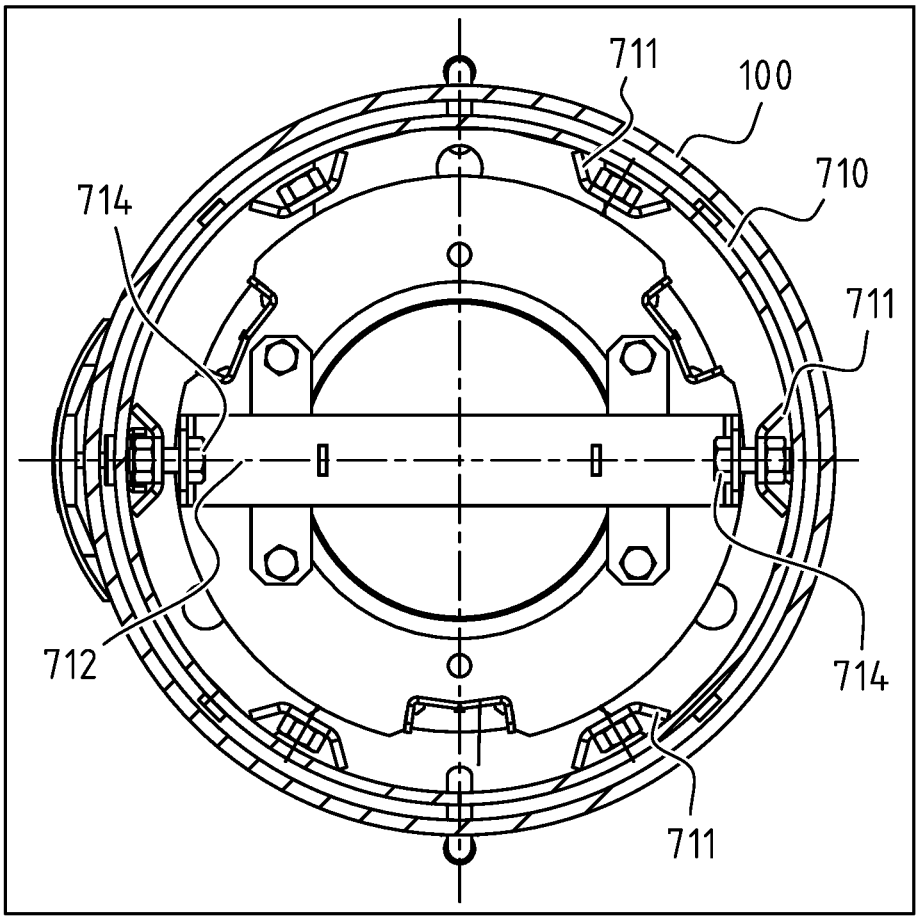

As shown in FIGS. 2B and 2H the lamp post 1000 may further comprise a functional module 500 arranged above the tubular pole 100, and a connection structure 700 for connecting the modular support structure 200, 200' to the functional module 500. In other embodiments (see also FIG. 5 which will be discussed below), the functional module 500 may be arranged below the tubular pole 100, and there may be provided a connection structure 700 for connecting the modular support structure 200, 200' to the functional module 500 below.

As shown in FIGS. 2B and 2H, the connection structure 700 comprises a metal insert 710 arranged partially in an end portion of the tubular pole 100, here in an upper end portion. In an embodiment where the functional module 500 is located below the pole 100, as in FIG. 5, the metal insert 710 may be arranged at least partially in a lower end portion of the tubular pole 100. The metal insert 710 may be fixed to the pole 100 using glue. The metal insert 710 may have a shape adapted to fit tightly in the pole 100. The modular support structure 200, 200' is connected to the metal insert 710. To that end attachment means 711, 712 are provided, see FIGS. 2C, 2H and 2I, allowing the carrier module 200 to be attached in a plurality of different positions. In the illustrated example, the attachment means comprises six nut structures 711 fixed to the metal insert 710, a bracket 712 fixed to the carrier module 200, and two bolts 714 extending through end parts 716 of bracket 712 for cooperating with two nut structures 711. The end parts 716 may be formed as hooks hooking over bolts 714. In the illustrated example six different positions are possible, such that the carrier module 200 is rotatable, here over 60°, from one position to another position of said six different of positions. As explained above, the connection interfaces 320, 330 of a spacer 300 and the connection interfaces 220, 230 of a carrier module 200 are also configured such that the second carrier module 200' can be positioned in different positions, here six different positions, with respect to the first carrier module 200. This will allow the second component 400' to be oriented in a suitable direction with respect to the orientation of the first components 400.

As shown in FIG. 2B, the connection structure further comprises an internal module 720 connected to the metal insert 710 and arranged at least partially in the metal insert 710. The internal module 720 has an upper connection interface, and the functional module 500 has a corresponding lower connection interface. The connection structure 700 may further comprise two connectors 731, 732 for connecting the corresponding connection interfaces of the internal module 720 and the functional module 500. The connectors 731, 732 and the corresponding connection interfaces may be as described in EP 3 076 073 B1 in the name of the applicant. The two connector portions 731, 732 can be clamped around round end parts of the corresponding connection interfaces, such that the functional module 500 can be rotated around an axial direction A of the pole 100 in a desired position and then fixed by the connectors 731, 732. The corresponding connection interfaces may comprise a central passage for cables and wires. Also, the internal module 720 may comprise a central passage for cables and/or wires.

In the embodiment of FIGS. 1A-1C, a light module 600 is arranged above the functional module 500, wherein the light module 600 comprises a light source. In another embodiment a light module 600 is arranged below the functional module 500, wherein the light module 600 comprises a light source. In another embodiment the functional module 500 may be a light module and the light module 600 may be omitted. In a possible embodiment the lamp post 1000 is provided with a driver for driving the light source and a control means (not shown) for controlling the driver in function of e.g. data received by one or more antenna components 400, 400'. However, in typical embodiments, the one or more antenna components 400, 400' will be used for communication between citizens. Optionally, the control means may be provided on top of the lamp post, and may be configured for wireless communication with a remote device and for controlling the driver. The control means may be included in a dedicated functional module, or may be added to another module. For example, a top light module may be provided with a socket, such as a NEMA or Zagha socket, in which an external control module is plugged.

The functional module 500 may comprise any one or more of the following functionalities: a light source, driver circuitry for driving a light source, base station circuitry, power management circuitry, telecommunication circuitry, audio system management circuitry, WiFi circuitry, charger circuitry, an environmental sensor and the associated circuitry, a human interface device (HID) and the associated circuitry, such as a camera, a loudspeaker, a button, a display, a signaling device, a plug-in device, a sensor such as radar sensor, sound sensor, vibration sensor and the associated circuitry, a socket such as an electrical socket, a repeater circuitry, a sign such as a publicity banner, a water discharge device, a trash bin, an antenna. More in particular, one or more of the following functionalities may be provided:

- power management circuitry comprising e.g. one or more of: a power meter, a fuse, a line protection, a circuit breaker, an electrical connection for multiple power lines, a clock, an astroclock, a power supply module, an PLC, a computer, a communication module, display circuitry, etc.; preferably the power management circuitry is configured to manage the provision of power to one or more lamp posts, preferably at least three lamp post, e.g. more than ten lamp posts.

In such embodiments power connection cables pass from the functional module through the support pole to other lamp posts, e.g. underground.

- telecommunication circuitry for wired or wireless communication, which can comprise at least one of: an optical fiber connection, a fiber to copper interface, a fiber patch panel, a modem, a router, a switch, a patch panel, a network video recorder (NVR), a computer;
- audio system management circuitry which can comprise at least one of: an amplifier, a transformer, a media player (connected to network or not), electrical connections for multiple loudspeaker lines, a computer;
- WiFi circuitry;
- charger circuitry, e.g. phone/computer/tablet charger circuitry or vehicle charger circuitry or UAV charger circuitry (e.g. drone charger circuitry);
- an environmental sensor such as a sound sensor, a microphone, a voice recorder, or a detector of CO2, NOx, smoke, or any other pollutant sensor, or an image sensor, etc., and the associated circuitry;
- any human interface device (HID) and the associated circuitry;
- a signaling device, e.g. a light ring capable of performing signaling;
- a mechanical and/or electrical plug-in device, e.g. a universal plug-in module, e.g. a mechanical device to fix a flag, a waste bin, etc.; a socket plug-in device.

Figure 5:
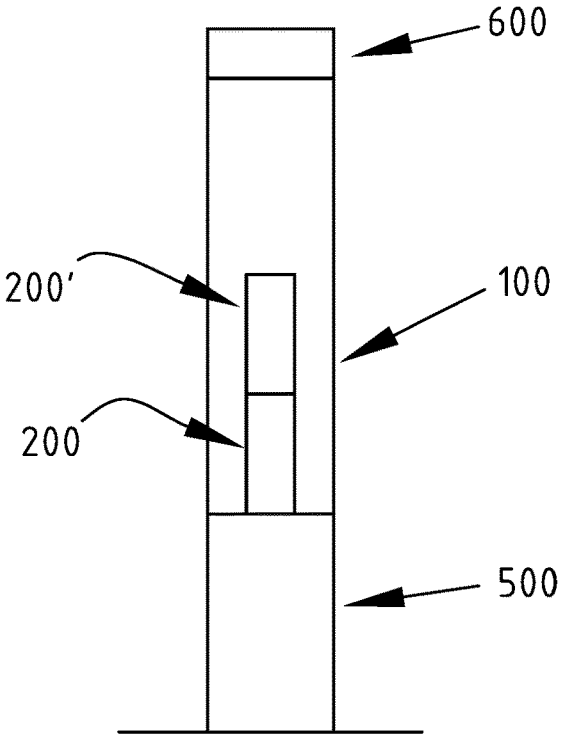
FIGS. 5 and 6 illustrate schematically two further exemplary embodiments of a lamp post.
Figure 6:
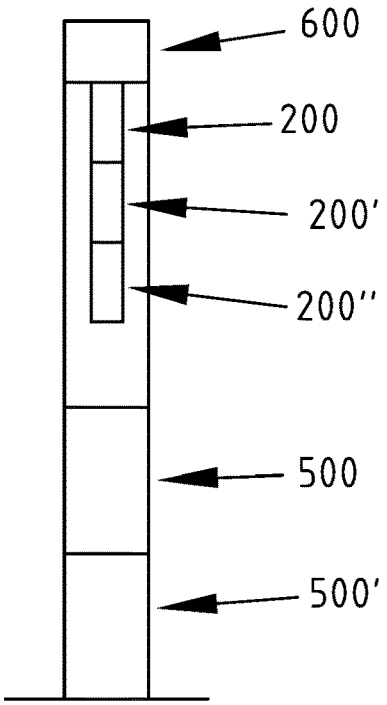

Also multiple functional modules 500 may be arranged in any order one above the other, above and/or below the tubular pole 100, and may be interconnected using connectors 731, 732 as described above. In the example of FIG. 5, a single functional module 500 is provided below the pole 100 and a light module 600 is provided above the pole 100. Both the functional module 500 and the light module 600 may be connected using a connection structure 700 as described above. The functional module 500 is connected to a modular support structure 200, 200', e.g. through a connection structure 700. In the example of FIG. 6, two functional modules 500, 500' are provided below the pole 100 and a light module 600 is provided above the pole 100. Both the functional module 500 and the light module 600 may be connected using a connection structure 700 as described above, and the functional modules 500, 500' may be connected using connectors as described in EP 3 076 073 B1 in the name of the applicant. The light module 600 is connected to a modular support structure 200, 200', 200", e.g. through a connection structure 700 as described above. In the embodiments of FIG. 5 or 6, there may be provided a support pole (not shown) which is fixed in the ground G and which is arranged below the functional modules 500, 500'. FIG. 6 further illustrates that more than two carrier modules 200, 200', 200" may be arranged in the tubular pole 100. Also, in further developed embodiments (not shown), there could be provided a first modular support structure with one or more carrier modules inserted at the top end of the pole and a second modular support structure with one or more carrier modules inserted at the bottom end of the pole.

In embodiments of the invention, the first and second component may be a substantially cylindrical antenna component comprising a plurality of cylinder segments, wherein each segment is associated with an antenna element, such that substantially 360° is covered. However, the antenna component 400, 400' may also be a directional antenna with a limited angular range, e.g. a range covering between 90° and 180°. When using multiple such antenna components 400, 400' arranged one above the other, and rotated with respect to each other, it is then still possible to cover substantially 360°. It is noted that also when a substantially cylindrical antenna component comprising a plurality of cylinder segments is used, there exist areas between the segments which will have a limited reception. If the orientation of the second antenna component is different with respect to the first antenna component (e.g. rotated over an angle which is different from 360° divided by the number of segments), such directions of low reception can be avoided.

Whilst the principles of the invention have been set out above in connection with specific embodiments, it is to be understood that this description is merely made by way of example and not as a limitation of the scope of protection which is determined by the appended claims.

The invention claimed is:

1. A lamp post comprising:

a tubular pole made out of a non-metallic material; and a modular support structure arranged in said pole, said modular support structure comprising at least one carrier module for carrying at least one component, wherein the carrier module comprises a top interface, a bottom interface and an elongated structure between the top and bottom interface, wherein the at least one carrier module comprises a first carrier module and a second carrier module for carrying a first and a second component, respectively, said first carrier module being arranged above or below the second carrier module, wherein the first and the second carrier module each comprise a first interface, a second interface and an elongated structure between the first and second interface, and wherein the second interface of the first carrier module is connected to the first interface of the second carrier module, and wherein a spacer is arranged between the first and the second carrier module, said spacer comprising an upper connection interface, a lower connection interface, and an elongated structure extending between the upper connection interface and the lower connection interface.

2. The lamp post according to claim 1, wherein the first carrier module is formed as a first rigid frame and wherein the second carrier module is formed as a second rigid frame which is distinct from the first rigid frame.

3. The lamp post according to claim 1, wherein the non-metallic material is a fiber reinforced plastic material.

4. The lamp post according to claim 1, wherein the at least one component comprises any one of the following: an antenna component, a wireless communication device, a sensor device.

5. A lamp post comprising:

a tubular pole made out of a non-metallic material; and a modular support structure arranged in said pole, said modular support structure comprising at least one carrier module for carrying at least one component, wherein the carrier module comprises a top interface, a bottom interface and an elongated structure between the top and bottom interface, and wherein the elongated structure comprises a plurality of bars extending between the top interface and the bottom interface.

6. The lamp post according to claim 5, wherein the plurality of bars are distributed along a periphery of the carrier module.

7. The lamp post according to claim 1, wherein the top interface comprises at least one round flange, and/or wherein the bottom interface comprises at least one round flange.

8. The lamp post according to claim 1, further comprising at least one functional module arranged above or below the tubular pole, and a connection structure for connecting the modular support structure to a functional module of the at least one functional module.

9. The lamp post according to claim 8, wherein the connection structure comprises a metal insert arranged at least partially in an end portion of the tubular pole.

10. The lamp post according to claim 9, further comprising attachment means configured to allow the modular support structure to be attached in a plurality of positions to the metal insert, such that the support structure is rotatable from one position to another position of said plurality of positions.

11. The lamp post according to claim 9, wherein the connection structure further comprises an internal module connected to the metal insert and arranged at least partially in the metal insert, said internal module having a connection interface, wherein the functional module has a corresponding connection interface.

12. The lamp post according to claim 8, wherein the at least one functional module comprises any one or more of the following functionalities: a light source, driver circuitry for driving a light source, base station circuitry, power management circuitry, telecommunication circuitry, audio system management circuitry, WiFi circuitry, charger circuitry, an environmental sensor and the associated circuitry, a human interface device and the associated circuitry, a loudspeaker, a button, a display, a signaling device, a plug-in device, a sensor, sound sensor, vibration sensor and the associated circuitry, a socket, a repeater circuitry, a sign, a water discharge device, a trash bin, and an antenna.

13. The lamp post according to claim 8, comprising a light module arranged above the functional module, said light module comprising a light source.

14. The lamp post according to claim 1, wherein the top and/or bottom interface is provided with one or more anti-vibration elements extending from an outer circumference of the top and/or bottom interface in a direction of the tubular pole.

15. The lamp post according to claim 1, further comprising connection lines for connecting the at least one component, wherein the connection lines are arranged along the elongated structure.

16. The lamp post according to claim 1, wherein the tubular pole is provided with at least one of at least one removable door providing access to an inner part of said tubular pole, a pole base part buried in the ground, said pole base part optionally being provided with a base plate and/or with a cable entry opening.

17. The lamp post according to claim 1, wherein the non-metallic material comprises a translucent or transparent material.

18. A lamp post comprising:

a tubular pole; and a modular support structure arranged in said pole, said modular support structure comprising at least one carrier module for carrying at least one component, wherein the carrier module comprises a top interface, a bottom interface and an elongated structure between the top and bottom interface, wherein the elongated structure comprises a plurality of bars extending between the top interface and the bottom interface, and wherein the plurality of bars are distributed along a periphery of the carrier module.

* * * * *